US011388792B2

(12) United States Patent
Lyu

(10) Patent No.: US 11,388,792 B2
(45) Date of Patent: Jul. 12, 2022

(54) CONTROL CIRCUIT, LED DRIVING CHIP, LED DRIVING SYSTEM AND LED DRIVING METHOD THEREOF

(71) Applicant: SHANGHAI BRIGHT POWER SEMICONDUCTOR CO., LTD, Shanghai (CN)

(72) Inventor: Jianjing Lyu, Shanghai (CN)

(73) Assignee: SHANGHAI BRIGHT POWER SEMICONDUCTOR CO., LTD., Shanghai (CN)

( * ) Notice: Subject to any disclaimer, the term of this patent is extended or adjusted under 35 U.S.C. 154(b) by 0 days.

(21) Appl. No.: 17/125,758

(22) Filed: Dec. 17, 2020

(65) Prior Publication Data

US 2021/0105875 A1 Apr. 8, 2021

Related U.S. Application Data

(63) Continuation of application No. PCT/CN2018/124691, filed on Dec. 28, 2018.

(30) Foreign Application Priority Data

Jun. 21, 2018 (CN) ..... 201810641598.0

(51) Int. Cl.
*H05B 45/14* (2020.01)
*H05B 45/392* (2020.01)
(Continued)

(52) U.S. Cl.
CPC ..... *H05B 45/14* (2020.01); *H05B 45/375* (2020.01); *H05B 45/38* (2020.01); *H05B 45/385* (2020.01); *H05B 45/392* (2020.01)

(58) Field of Classification Search
CPC ..... H05B 45/14; H05B 45/38; H05B 45/385; H05B 45/392; H05B 45/375; H05B 47/10; H05B 47/16
See application file for complete search history.

(56) References Cited

U.S. PATENT DOCUMENTS 9,232,606 B2 1/2016 Kuang
2007/0080905 A1* 4/2007 Takahara ..... G09G 3/3258 345/76
(Continued)

FOREIGN PATENT DOCUMENTS

CN 102412727 A 4/2012
CN 104168697 A 11/2014
(Continued)

OTHER PUBLICATIONS

PCT Search Report (English translation) for International Application No. PCT/CN2018/124691 dated Mar. 21, 2019, 2 pp.
(Continued)

*Primary Examiner* — Abdullah A Riyami
*Assistant Examiner* — Syed M Kaiser
(74) *Attorney, Agent, or Firm* — The Roy Gross Law Firm, LLC; Roy Gross

(57) ABSTRACT

The present invention discloses a control circuit, a LED driving system, and a LED driving method. The control circuit receives a feedback signal from the power converter and generate a ZCD pulse signal accordingly, indicating one or more moments when the feedback signal decreases to zero, and receives a dimming signal and generate a minimum turn-off time signal accordingly, indicating the moment when a minimum turn-off time is passed. The control circuit generates a first turn-on signal according to the ZCD pulse signal and the minimum turn-off time signal to control a switching device within the power converter to turn on when the feedback signal decreases to zero and the minimum turn-off time is passed.

15 Claims, 8 Drawing Sheets

(51) Int. Cl.

| | |
|---|---|
| ***H05B 45/385*** | (2020.01) |
| ***H05B 45/375*** | (2020.01) |
| ***H05B 45/38*** | (2020.01) |

(56) References Cited

U.S. PATENT DOCUMENTS

| | | | | |
|---|---|---|---|---|
| 2013/0134894 | A1* | 5/2013 | Kuang | H05B 45/14 315/224 |
| 2019/0089336 | A1* | 3/2019 | Hau | H03K 19/017509 |

FOREIGN PATENT DOCUMENTS

| | | | |
|---|---|---|---|
| CN | 105813260 | A | 7/2016 |
| CN | 108738201 | A | 11/2018 |

OTHER PUBLICATIONS

PCT Written Opinion for International Application No. PCT/CN2018/124691 dated Mar. 21, 2019, 4 pp.

* cited by examiner

CONTROL CIRCUIT, LED DRIVING CHIP, LED DRIVING SYSTEM AND LED DRIVING METHOD THEREOF

CROSS REFERENCE TO RELATED APPLICATION

This application is a continuation of International Application No. PCT/CN2018/124691, filed on Dec. 28, 2018, which claims priority to Chinese patent application No. 201810641598.0, filed on Jun. 21, 2018, the content of which are incorporated herein by reference in their entirety.

FIELD OF THE INVENTION

The present invention relates to the integrated circuit driving technology, and more specifically to a control circuit, a light emitting diode (LED) driving system and a LED driving method thereof, which can be applied to the dimmable LED light.

BACKGROUND OF THE INVENTION

"Dimmable" is an important advantage of LED light sources compared to traditional light sources. The precise control of the luminous intensity of LED light sources can create different atmospheres to meet diverse needs for lighting. Among a plurality of LED power supplies, the single-stage constant current driver with active power factor correction (APFC) meets relevant requirements of power factor and input current harmonics, while its peripheral circuit is simpler and cost-wiser compared to that of a two-stage topology. As a result, this type of driver has been widely used.

Refer to FIGS. 1 and 2A-2C, among which FIG. 1 is a schematic diagram of an isolated flyback with APFC, used as constant current LED driving system, FIG. 2A is a timing diagram of signals of the system as shown in FIG. 1, FIG. 2B is a diagram of different moments of turn-on of switch M1 and drain voltage of the power switch in the system as shown in FIG. 1, and FIG. 2C is a diagram of line voltage with spike and corresponding moments of turn-on of switch M1 as shown in FIG. 1.

In FIG. 1, an AC power supply (typically 85~264Vrms) is rectified by a bridge circuit 11 and filtered by a bus capacitor C1, then coupled to a primary winding T11 of a transformer T1. A secondary winding T12 of the transformer T1, a freewheeling diode D2, an output capacitor C4, and a dummy load R4 are configured to drive LED load 19. A feedback signal FB1 is obtained from a voltage divider formed by R2 and R3, which is connected to an auxiliary winding T13. A sampling resistor Rcs samples the current flowing through a switch M1, and sends it to a CS pin of a chip 12, and a capacitor C3 is connected between a compensation pin COMP and the ground pin GND of the chip 12. A resistor R1, a capacitor C2 and a diode D1 form an absorption circuit coupled to the primary winding T11, to suppress voltage spikes.

The chip 12 is further shown in detail in FIG. 1. The chip 12 comprises an output current sampling module 122 receives a signal reflecting the current flowing through the switch M1 via a CS pin, and sends a current sampling signal into an inverting input end of an error amplifier EA. A reference voltage generation module Vr1 in the Chip 12 obtains a dimming signal VDIM through a DIM pin, generates a reference voltage Vref based on the dimming signal VDIM and sends it into a positive input end of the error amplifier EA. An output end of the error amplifier EA is connected to the compensation pin COMP, where a compensation signal COMP1 is obtained and compared with a ramp signal to control the turn-on time Ton of the switch M1. When the voltage of the current sampling signal is lower than the reference voltage Vref, the current flowing out of the error amplifier EA increases the voltage of the compensation signal COMP1 to increase the turn-on time Ton, thereby increasing the output current. When the voltage of the current sampling signal is higher than the reference voltage Vref, the current flowing into the EA decreases the voltage of the compensation signal COMP1 to decrease the turn-on time Ton, thereby decreasing the output current. When the system is finally stabilized, the current flowing through the switch M1 equals to a set value. Adjusting the reference voltage Vref, the loop will then adjust the turn-on time Ton, so that the output current is changed accordingly, thereby achieving the dimming function thereof.

The chip 12 further comprises a minimum turn-off time module 123 which obtains the dimming signal VDIM through the DIM pin and generates a minimum turn-off time Mot accordingly. As the dimming signal VDIM increases, the minimum turn-off time Mot is shortened while the reference voltage Vref is increased. In contrast, ss the dimming signal VDIM decreases, the minimum turn-off time Mot is increased while the reference voltage Vref is decreased. The turn-on time Ton continues to decrease and the switching frequency Fsw continues to increase as the LED light dims. When the turn-on time Ton is less than the minimum turn-on time Tonmin, the dimming function will fail.

In order to avoid the misfunctions mentioned above, it is useful to keep the turn-on time Ton longer than the minimum turn-on time Tonmin by adjusting the minimum turn-off time Mot or setting the maximum switching frequency Fsw_max during the dimming process. In the existing control method, the switch M1 is turned on when the minimum turn-off time Mot and a zero current detection signal ZCD are both high (ZCD is generated by a demagnetization detection module 121 in the Chip 12).

In some situations, the LED driving system operates in a Discontinuous Conduction Mode (abbreviated as DCM), when there exists a dead time. During the dead time, the waveforms of a secondary current Isec flowing through the secondary winding T12 and a feedback signal FB1 are shown in FIG. 2*a*. At time t1, the diode D2 is off since the secondary current Isec falls to zero. Due to resonance of the parasitic capacitance of the switch M1 and the inductance of the transformer T1, the feedback signal FB1 starts to decrease rapidly and the secondary current Isec is reversed. At time t2, the secondary current Isec reaches the negative maximum value. At time t3, the secondary current Isec turns back to zero, and the feedback signal FB1 reaches a negative maximum value. Then the feedback signal FB1 decreases, and back to zero at time t4. The feedback signal FB1 reaches a positive maximum value at time t5, and the secondary current Isec turns reversed again, starting the next cycle of resonance. The zero current detection signal ZCD is high when feedback signal FB1 is negative, so the switch M1 may be turned on during time (t2-t4) (referred to as the $1^{st}$ valley), during time (t6-t8) (referred to as the $2^{nd}$ valley), or during the subsequent $n^{th}$ valley. When the switch M1 is turned on at different times, an initial secondary current Isec0 will be different so that a corresponding initial primary current Ipri0 of a next switching cycle is also different. The primary current during the next switching cycle has a peak value Ipk=(Vin/L)*Ton+Ipri0=(Vin/L)*Ton+Isec0/Nps (wherein L is the inductance value of the transformer T1). The demagnetization time of the transformer T1 is Tdis=Ipk*L/(Nps*Vout), wherein Vout is the output voltage. As shown in FIG. 2B, when the bus voltage Vin increases, the primary peak current Ipk increases accordingly, so as the demagnetization time Tdis. So that the time point that the switch M1 turns on gradually moves from the $n^{th}$ valley to the $(n-1)^{th}$ valley. In contrast, the time point that the switch M1 turns on switches moves from the $(n-1)^{th}$ valley to the $n^{th}$ valley when the bus voltage Vin decreases. During the operation, the bus voltage Vin corresponding to the situation when the time point that the switch M1 turns on moves from $n^{th}$ valley to the $(n-1)^{th}$ valley, is higher than the bus voltage Vin corresponding the situation when the time point that the switch M1 turns on moves from $(n-1)^{th}$ valley to the $n^{th}$ valley, presenting an asymmetry of operation of the LED driving system.

Refer to FIG. 2A, as Tdis varies with Vin and Mot remains unchanged, the time point that the switch M1 turns on moves from $1^{st}$ valley to $2^{nd}$ valley when Tdis decreases, of which the switch from $1^{st}$ valley to $2^{nd}$ valley corresponds to Isec0(t4) and Vin(t4); the time point that the switch M1 turns on moves from $2^{nd}$ valley to $1^{st}$ valley when Tdis increases, of which the switch from $2^{nd}$ valley to $1^{st}$ valley corresponds to Isec0(t6) and Vin(t6). Since the change of demagnetization time Tdis of the two situations is small and negligible, the peak value of primary current Ipk is also the same according to equations mentioned above. So the equation Vin(t6)*Ton/L+Isec0(t6)=Vin(t4)*Ton/L+Isec0(t4) is obtained from the above-mentioned equation Ipk=(Vin/L)*Ton+Isec0/Nps. From FIG. 2A, it can be seen that Isec0(t6)<Isec0(t4), which gives Vin(t4)>Vin(t6). It should be noted that t1, t2 . . . t8 only represent specific points of the waveforms in FIG. 2A for better illustration, but not actual time points during operation.

As shown in FIG. 2C, with the control method applied, if there is a positive spike shown as dt1, the time point that the switch M1 turns on would move from the $3^{rd}$ valley to the $2^{nd}$ valley earlier, then it will be unable to return to the $3^{rd}$ valley due to the existence of the above-mentioned asymmetry. Eventually a difference of operation time exists between the $2^{nd}$ valley and the $3^{rd}$ valley. Due to differences of the energy transmit in different valleys, average value of output current varies and causes flickers visible to human eyes.

SUMMARY OF THE INVENTION

One object of the present invention is to provide a control circuit, a LED driving system, and a LED driving method, which aim to solve the technical problem of visible flickers due to asymmetry of valley switch existed in prior LED driving system.

The present invention provides a control circuit. The control circuit is configured to receive a feedback signal from the power converter and generate a ZCD pulse signal accordingly, indicating one or more moments when the feedback signal decreases to zero, and receives a dimming signal and generate a minimum turn-off time signal accordingly, indicating the moment when a minimum turn-off time is passed, and wherein the control circuit generates a first turn-on signal according to the ZCD pulse signal and the minimum turn-off time signal to control a switching device within the power converter to turn on when the feedback signal decreases to zero and the minimum turn-off time is passed.

The present invention also provides an LED driving system. The LED driving system includes an AC power supply, a rectifier, a bus capacitor, a magnetic device, a switching device, and one or more LED loads, wherein the AC power supply is coupled to the magnetic device to drive the LED loads; and wherein the LED driving system further comprises a control circuit, which receives a feedback signal from the magnetic device and generate a ZCD pulse signal accordingly, indicating one or more moments when the feedback signal decreases to zero, and receives a dimming signal and generate a minimum turn-off time signal accordingly, indicating the moment when a minimum turn-off time is passed, and wherein the control circuit generates a first turn-on signal according to the ZCD pulse signal and the minimum turn-off time signal to control the switching device to turn on when the feedback signal decreases to zero and the minimum turn-off time is passed.

The present invention also provides a LED driving method applied in an LED driving system. The LED driving method includes: receiving a feedback signal and generating a ZCD pulse signal accordingly, which indicates one or more moments when the feedback signal decreases to zero; receiving a dimming signal and generating a minimum turn-off time signal accordingly, which indicates the moment when a minimum turn-off time is passed; generating a first turn-on signal according to the ZCD pulse signal and the minimum turn-off time signal; and generating a switch control signal according to the first turn-on signal, controlling a switching device to turn on when the feedback signal decreases to zero and the minimum turn-off time is passed.

The control circuit provided by the present invention introduces a ZCD pulse signal that indicates the moment when the voltage of an auxiliary winding falls below zero, so as to ensure that initial values of the primary current corresponding to the moments when the power switch is turned on are the same, thus eliminating low-frequency flickers caused by the asymmetry of the valley switch in traditional LED driving system. Further, by introducing the latched ZCD pulse signal and the delayed minimum turn-off time signal, the switch will be forced to be turned on when the first moment of the feedback signal decreasing to zero has arrived and the delayed minimum turn-off time is passed, thereby eliminating flickers even in deeply dimming and improving user experiences.

BRIEF DESCRIPTION OF THE DRAWINGS

In order to illustrate technical solutions in embodiments of the present invention more clearly, drawings to be used to illustrate the embodiments will be briefly described below. Obviously, the drawings in the following description are merely some embodiments of the present inventions, other drawings may be obtained based on the drawings for those skilled in the art without any creative work.

DETAILED DESCRIPTION OF THE INVENTION

Figure 1:
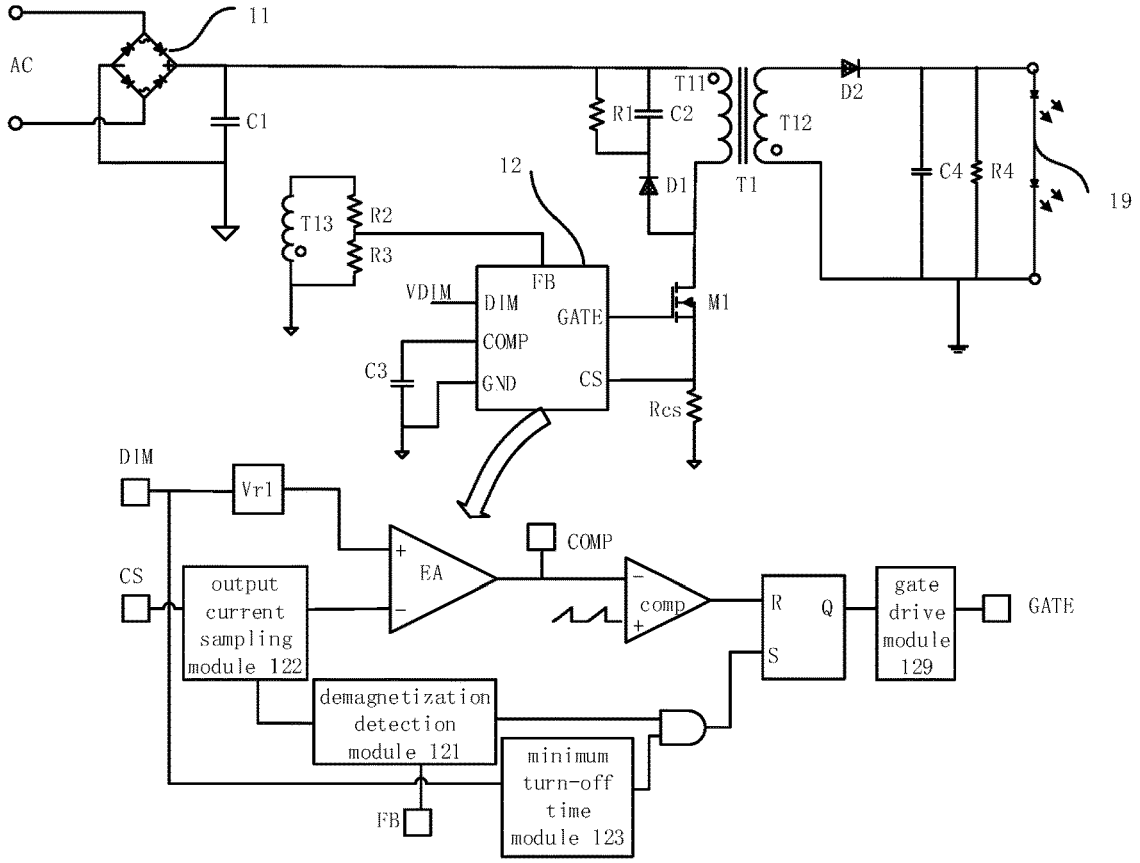
FIG. 1 is a schematic diagram of an isolated flyback driving system with APFC.
Figure 2A:
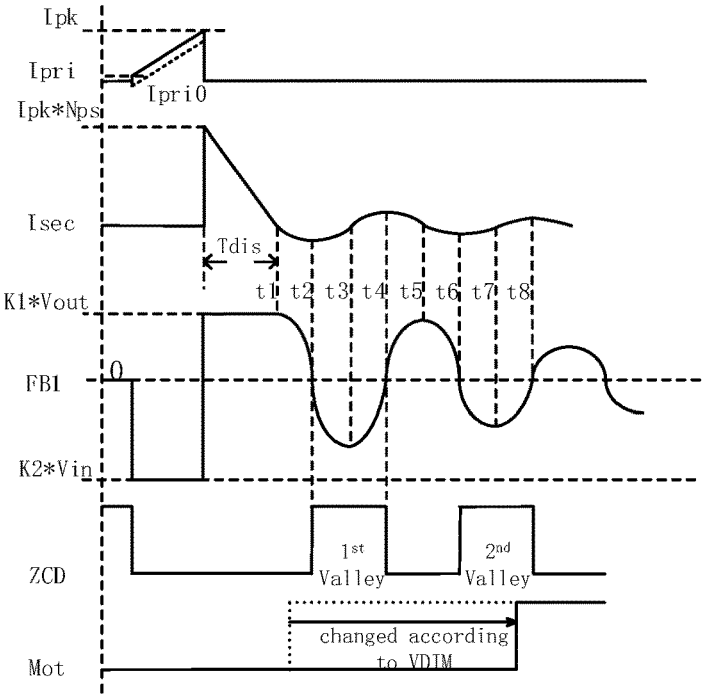
FIG. 2A is a diagram of signals of the isolated flyback driving system as shown in FIG. 1
Figure 2B:
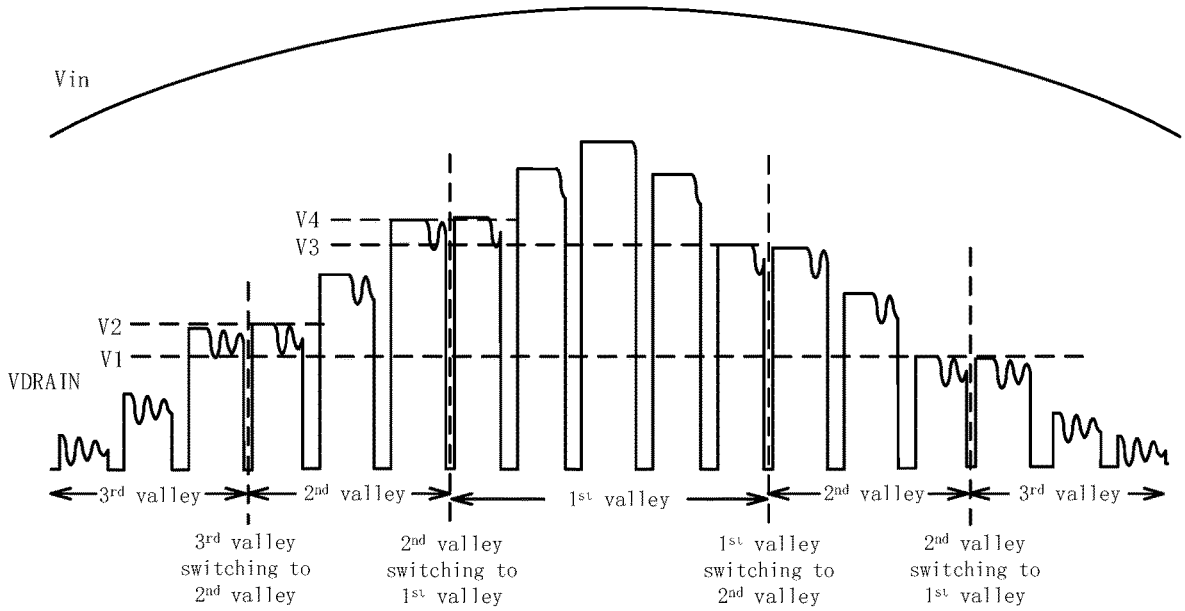
FIG. 2B is a diagram of different moments of turn-on and drain voltage of the switch M1 in the system shown in FIG. 1
Figure 2C:
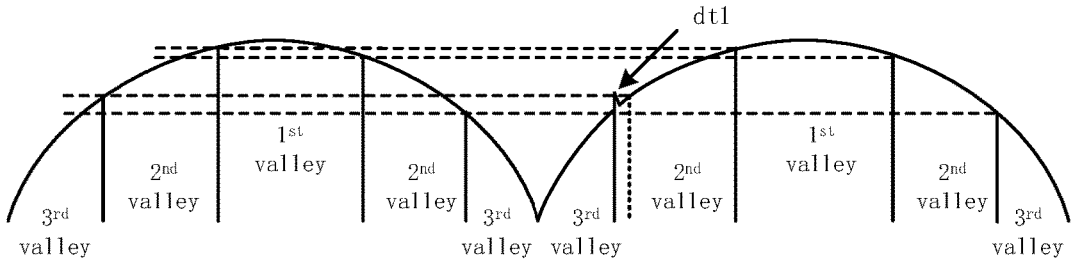
FIG. 2C is a diagram of line voltage with spike and corresponding moments of turn-on of the switch M1 shown in FIG. 1.

The embodiments of the present invention are described in detail below. Examples of the embodiments are shown in the drawings, in which same or similar reference numerals indicate same or similar elements or elements having same or similar functions. The embodiments described below with reference to the drawings are exemplary, and are only used to explain the present invention, but cannot be interpreted as limitations to the present invention.

The following disclosure provides many different embodiments or examples for implementing different structures of the present invention. To simplify the disclosure of the present invention, components and settings of specific examples are described below. Of course, they are merely examples, of which the purpose is not to limit the invention. In addition, the present invention may repeat reference numerals and/or reference letters in different examples. Such repetition is for the purpose of simplicity and clarity and does not itself indicate the relationship between various embodiments and/or settings as discussed. In addition, the present invention provides various examples of specific processes and materials, but those skilled in the art may be aware of the application of other processes and/or the use of other materials.

Figure 3A:
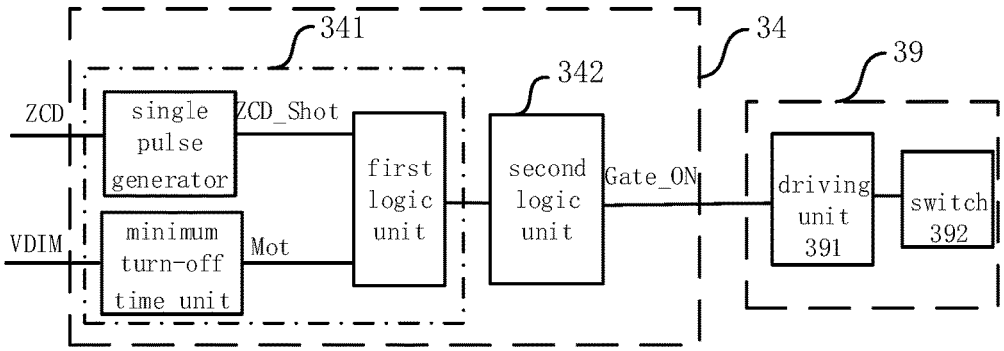
FIG. 3A is a schematic diagram of a first embodiment of the control circuit in accordance with the present invention.

Please refer to FIG. 3A, which is a schematic diagram of a first embodiment of the control circuit in accordance with the present invention. A control circuit 34 receives a dimming signal VDIM and a zero current detection signal ZCD, and generates a ZCD pulse signal ZCD_shot according to the zero current detection signal ZCD, generates a minimum turn-off time signal Mot according to the dimming signal. The control circuit 34 also generates a first turn-on control signal according to the ZCD pulse signal ZCD_shot and the minimum turn-off time signal Mot, and outputs the first turn-on control signal to control the switching device 392 to turn on.

Figure 3B:
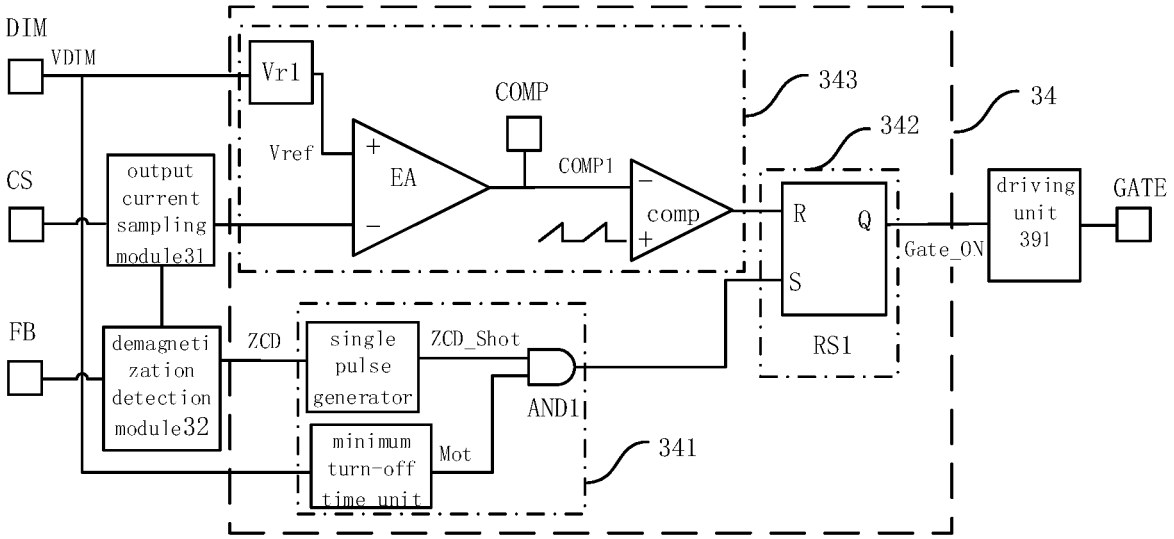
FIG. 3B is a schematic diagram of a second embodiment of the control circuit in accordance with the present invention.
Figure 3C:
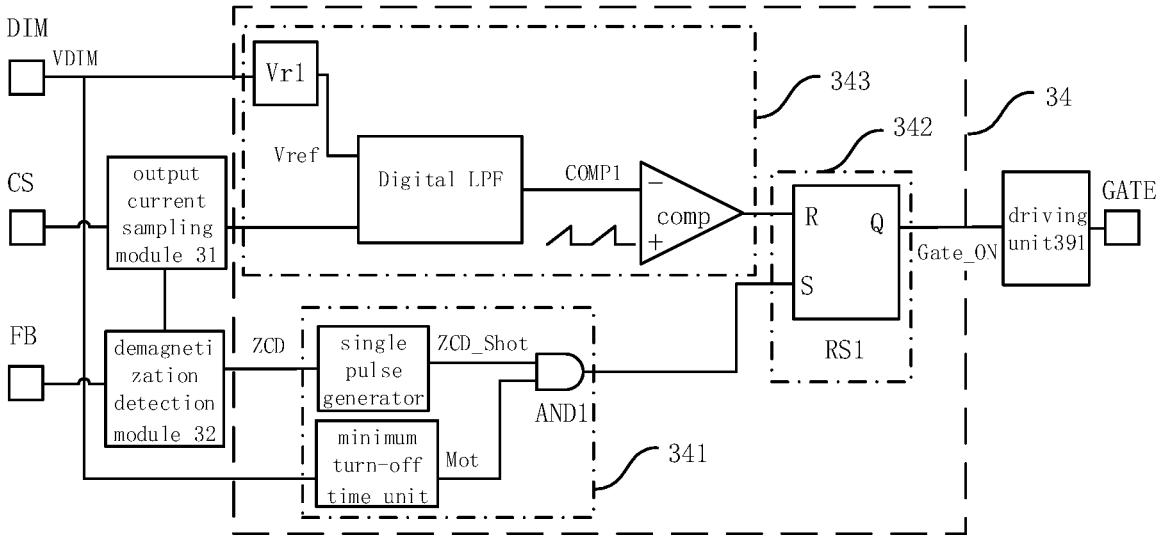
FIG. 3C is a schematic diagram of a third embodiment of the control circuit in accordance with the present invention.

Specifically, the control circuit 34 includes a turn-on signal generation module 341 and a second logic unit 342. Refer to FIG. 3B, the turn-on signal generation module 341 further comprises a single pulse generator, a minimum turn-off time unit and a first logic unit; the single pulse generator is configured to receive the zero current detection signal ZCD, generate the ZCD pulse signal ZCD_shot according to the zero current detection signal ZCD, and output the ZCD pulse signal ZCD_shot to a first input end of the first logic unit; the minimum turn-off time unit is configured to receive the dimming signal VDIM, generate the minimum turn-off time signal Mot according to the dimming signal, and output the minimum off-time signal Mot to a second input end of the first logic unit; the first logic unit is configured to generate the first turn-on signal based on the ZCD pulse signal ZCD_shot and the minimum turn-off time signal Mot and output it to the second logic unit 342; and the second logic unit 342 is configured to generate the switch control signal Gate_ON at least based on the first turn-on signal.

In one embodiment, a switching module 39 includes a driving unit 391 and a switch 392. The driving unit 391 is configured to receive a switch control signal Gate_ON and generate a switch driving signal. The switch 392 is driven by the switch driving signal to turn on/off. The switch may comprise one or more MOSFETs, transistors, and thyristors.

Preferably, refer to FIG. 3B, the control circuit 34 is further configured to generate a first reference voltage Vref according to the dimming signal VDIM, and generate an output current sampling signal representing a current flowing through the switch 392, and generate a turn-off signal according to the first reference voltage and the output current sampling signal, and generate the switch control signal Gate_ON based on the turn-off signal and the first turn-on signal to control the switch 392.

Figure 4A:
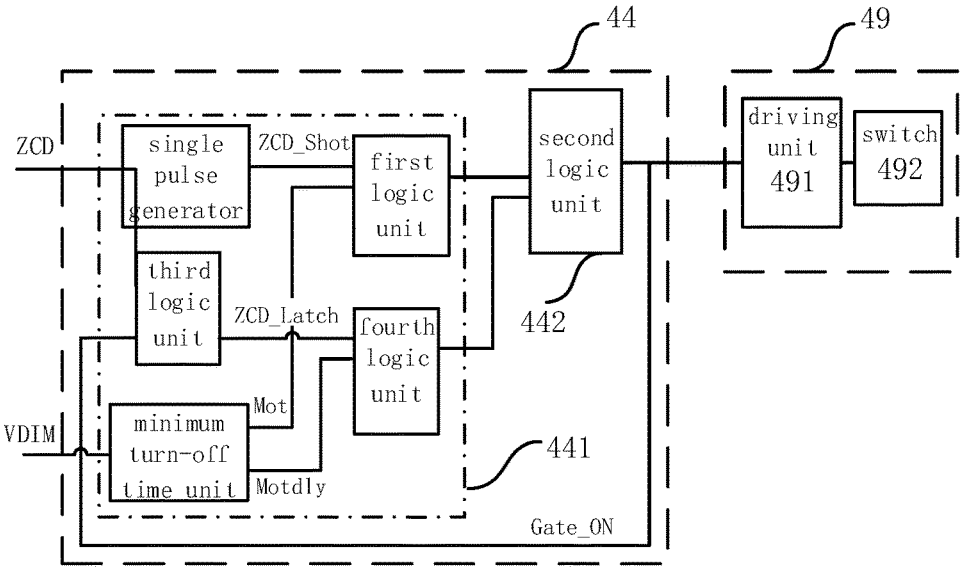
FIG. 4A is a schematic diagram of a forth embodiment of the control circuit in accordance with the present invention.
Figure 4B:
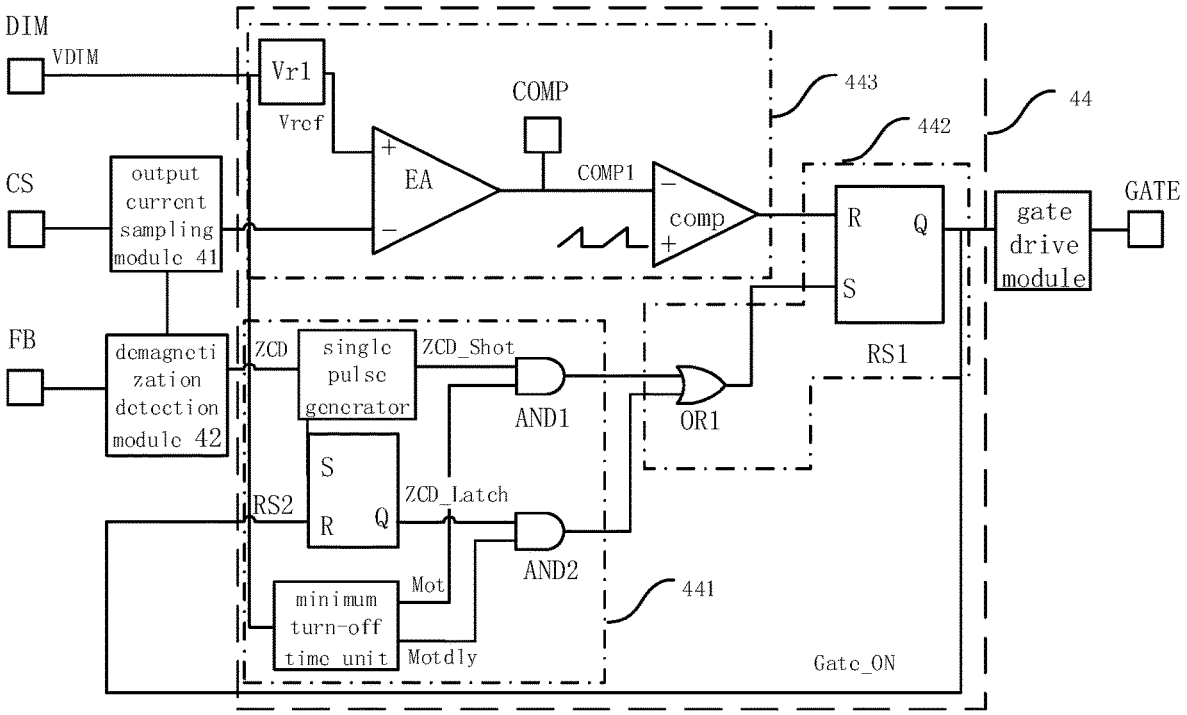
FIG. 4B is a schematic diagram of a fifth embodiment of the control circuit in accordance with the present invention.
Figure 4C:
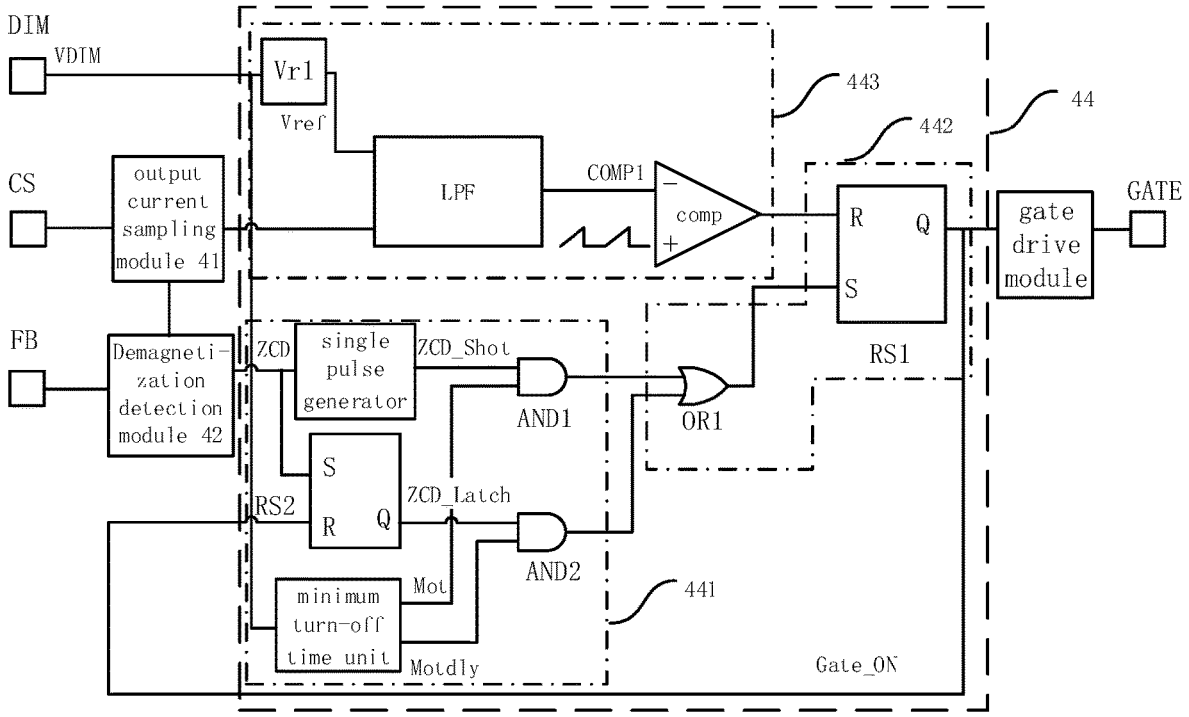
FIG. 4C is a schematic diagram of a sixth embodiment of the control circuit in accordance with the present invention.

In some embodiments, as shown in FIG. 3B and FIG. 4B, the control circuit 34 is configured to perform an error amplification of the output current sampling signal and the first reference voltage Vref, generate a compensation signal COMP1 on a compensation capacitor and a turn-off signal according to the compensation signal COMP1.

In other embodiments, the control circuit 34 is configured to perform digital low-pass filtering of the difference between the output current sampling signal and the first reference voltage Vref, generate a compensation signal COMP1 on a compensation capacitor and a turn-off signal according to the compensation signal COMP1.

The logic units (first logic unit, second logic unit) in accordance with the present invention may comprise a circuit including logic components. Specifically, the logic components may include, but is not limited to, analog logic components and/or digital logic components. Among which, the analog logic components are used for processing analog electrical signals and may include, but is not limited to, a combination of one or more logic components such as comparators, AND gates and OR gates; while the digital logic components are used for processing digital signals and may include, but is not limited to, a combination of one or more logic components/devices such as flip-flops, logic gates, latches, selectors, and the like.

In one embodiment, the first logic unit comprises a first AND gate AND1. The first AND gate AND1 receives the ZCD pulse signal ZCD_shot and the minimum turn-off time signal Mot to generate the first turn-on signal. That is, the first turn-on signal is of high level when the ZCD pulse signal ZCD_shot and the minimum turn-off time signal Mot are both of high level.

In one embodiment, the second logic unit 342 comprises a first RS flip-flop RS1. A input end S (for SET) of the first RS flip-flop RS1 is configured to receive the first turn-on signal, and a input end R (for RESET) of the first RS flip-flop RS1 is configured to receive the turn-off signal. The first RS flip-flop RS1 is configured to generate the switch control signal Gate_ON, which is output via an output end thereof to the driving unit 391. When the first turn-on signal is valid, the switch turns on; when the turn-off control signal is valid, the switch turns off.

Please refer to FIG. 3B, FIG. 3B is a schematic diagram of a second embodiment of the control circuit in accordance with the present invention. The control circuit is configured to receive a dimming signal VDIM via a DIM pin, and generate a minimum turn-off time signal Mot according to the dimming signal; receive a zero current detection signal ZCD and generate a ZCD pulse signal ZCD_shot according to the zero current detection signal; generate a turn-on signal according to the ZCD pulse signal ZCD_shot and the minimum turn-off time signal Mot; generate a switch control signal at least based on the turn-on signal, and output the switch control signal Gate_ON to control the switch 392.

Preferably in this embodiment in accordance with the present invention, the control circuit 34 is further configured to generate a first reference voltage Vref according to the dimming signal VDIM, and generate an output current sampling signal representing a current flowing through the switch 392, and generate a turn-off signal according to the first reference voltage and the output current sampling signal, and generate the switch control signal Gate_ON based on the turn-off signal and the first turn-on signal to control the switch 392.

Specifically, the control circuit 34 further includes a reference voltage generation unit Vr1, an error amplifier EA, and a comparator COMP; the reference voltage generating unit Vr1 is configured to receive the dimming signal VDIM, generate a first reference voltage Vref accordingly and output the first reference voltage to the error amplifier EA; the error amplifier EA is configured to generate a compensation signal COMP1 according to the first reference voltage Vref and the output current sampling signal, and output the compensation signal COMP1 to the comparator; the comparator is configured to compare the compensation signal COMP1 with a ramp signal to generate the turn-off signal; and the second logic unit 342 is further configured to receive the turn-off signal and the first turn-on signal to generate the switch control signal Gate_ON.

Please refer to FIG. 4A, which is schematic diagram of a forth embodiment of the control circuit in accordance with the present invention. Compared to the first embodiment shown in FIG. 3A, the control circuit 44 is further configured to generate a latched ZCD signal ZCD_Latch according to the zero current detection signal ZCD, and a delayed minimum turn-off time Motdly according to the dimming signal VDIM; generate a second turn-on signal according to the latched ZCD pulse signal ZCD_Latch and the delayed minimum turn-off time signal Motdly; and generate the switch control signal Gate_ON according to the second turn-on signal and the first turn-on signal.

Specifically, the control circuit 44 includes control circuit comprises a single pulse generator, a minimum turn-off time unit, a first logic unit, a second logic unit, a third logic unit and a fourth logic unit. The single pulse generator is configured to receive the zero current detection signal, generate the ZCD pulse signal ZCD_shot accordingly and output ZCD_shot to a first input end of the first logic unit. The minimum turn-off time unit is configured to receive the dimming signal VDIM, generate the minimum turn-off time signal Mot accordingly and output the minimum turn-off time signal Mot to a second input end of the first logic unit. The first logic unit is configured to generate a first turn-on signal according to the ZCD pulse signal ZCD_shot and the minimum turn-off time signal Mot and output it to the second logic unit. The third logic unit is configured to receive the zero current detection signal ZCD and the switch control signal Gate_ON, generate the latched ZCD pulse signal ZCD_Latch according to the zero current detection signal and the switch control signal, and output the latched ZCD pulse signal ZCD_Latch to a first input end of the fourth logic unit. The minimum turn-off time unit is further configured to generate the delayed minimum turn-off time signal Motdly according to the dimming signal and output the delayed minimum turn-off time signal Motdly to a second input end of the fourth logic unit. The fourth logic unit is configured to generate a second turn-on signal according to the latched ZCD pulse signal and the delayed minimum turn-off time signal Motdly and output it to the second logic unit. The second logic unit is configured to generate the switch control signal according to the second turn-on signal and the first turn-on signal.

In one embodiment, a switching module 49 includes a driving unit 491 and a switch 492. The driving unit 491 is configured to receive a switch control signal Gate_ON and generate a switch driving signal. The switch 492 is driven by the switch driving signal to turn on/off. The switch may comprise one or more MOSFETs, transistors, and thyristors.

Preferably, the control circuit 44 is further configured to generate a first reference voltage Vref according to the dimming signal VDIM and generate an output current sampling signal as described above.

Please refer to FIG. 4B, which is a schematic diagram of a fifth embodiment of the control circuit in accordance with the present invention. Compared with the first embodiment, the control circuit 44 further comprises a first logic unit, a second logic unit, a third logic unit and a fourth logic unit. The first logic unit includes a first AND gate AND1. The first AND gate AND1 performs a logic AND operation on the ZCD pulse signal ZCD_shot and the minimum turn-off time signal Mot to generate the first turn-on signal. The third logic unit uses a second RS flip-flop RS2. A input end S (for SET) of the second RS flip-flop RS2 is configured to receive the zero current detection signal ZCD and generate a zero current detection latch signal ZCD_Latch according to the zero current detection signal ZCD. An input end R (for RESET) of the second RS flip-flop RS2 is configured to receive the switch control signal Gate_ON. An output end of the second RS flip-flop RS2 outputs a zero current detection latch signal ZCD_Latch. The fourth logic unit includes a second AND gate AND2. The second AND gate AND2 performs a logic AND operation on the zero current detection latch signal ZCD_Latch and the delayed minimum turn-off time signal Motdly and generates a second turn-on signal. The second logic unit 442 includes a first OR gate OR1 and a first RS flip-flop RS1. The first OR gate OR1 performs a logic OR operation on the second turn-on signal and the first turn-on signal and output the OR operation result to an input end S (for SET) of the first RS flip-flop RS1. A input end R (for RESET) of the first RS flip-flop RS1 is configured to receive a turn-off signal and perform a logic processing operation on the OR operation result and the turn-off signal to generate a switch control signal Gate_ON, while an output end of the first RS flip-flop RS1 is configured to output a switch control signal Gate_ON to the gate drive module.

In any of embodiments in accordance with the present invention, the LED driving system may further comprise an output current sampling module 41, which is electrically connected to a CS pin and sample an electrical signal reflecting the current flowing through the switch M1, generate an output current sample signal. Moreover, the control circuit may comprise a FB pin and a demagnetization detection module 42, and the demagnetization detection module 42 is electrically connected to the FB pin to receiving the feedback signal FB1 from the transformer T1 (refer to FIG. 1), so as to generate a zero current detection signal ZCD and output it.

In another embodiment, the control circuit may also be directly electrically connected to the GATE pin to receive the feedback signal from the inductor or the transformer, perform a demagnetization detection and generate the zero current detection signal ZCD. That is, the FB pin is optional.

Figure 5A:
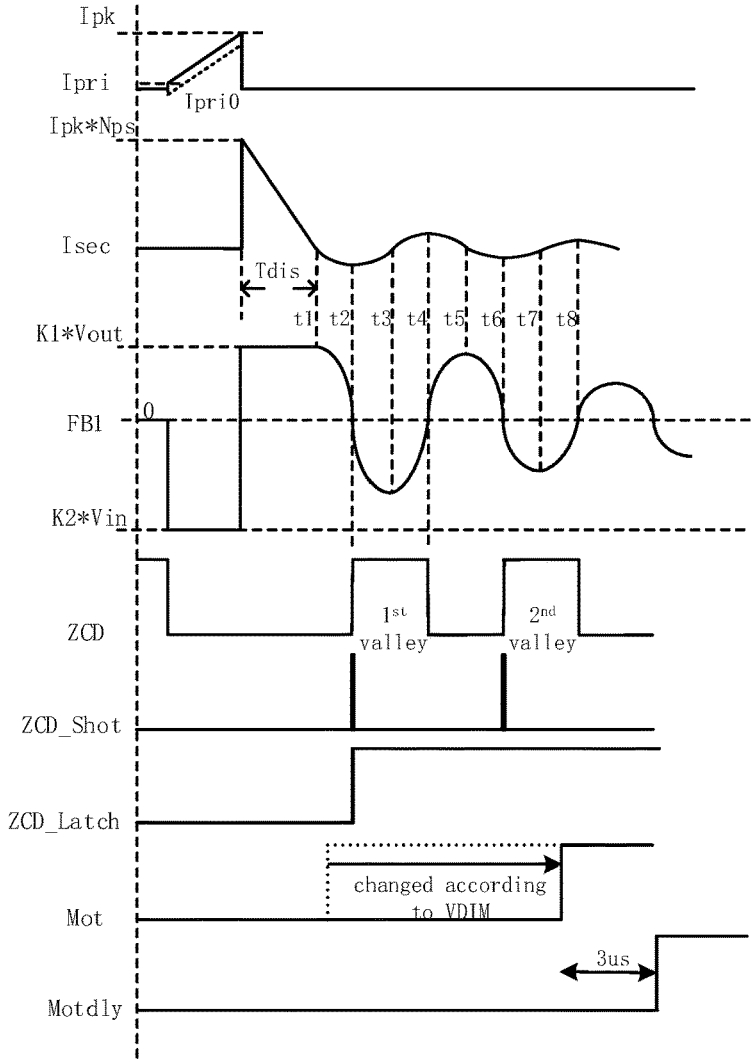
FIG. 5A is a schematic diagram of signals within the LED driving system in accordance with the present invention.
Figure 5B:
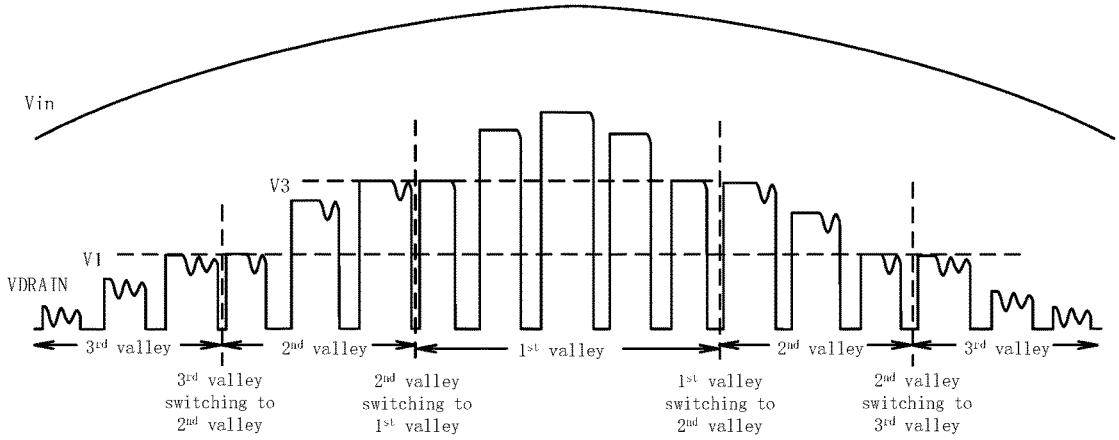
FIG. 5B is a diagram of different moments of turn-on and drain voltage of the power switch in accordance with the present invention.

The advantages of the LED driving system in accordance with the present invention will be further described with reference to FIGS. 5A-5C. Among which, FIG. 5A is a schematic diagram of signals within the LED driving system in accordance with the present invention. FIG. 5B is a diagram of different moments of turn-on and drain voltage of the power switch in accordance with the present invention, and FIG. 5C is diagram of line voltage with spike and corresponding moments of turn-on of the switch in the LED driving system in accordance with the present invention.

As shown in FIG. 5A, the ZCD pulse signal ZCD_shot is only high when the feedback signal FB1 falls below zero, for example, at times t2 and t6. The switch is turned on when the ZCD pulse signal ZCD_shot and the minimum turn-off time signal Mot are both high. With this mechanism, so as to ensure that initial values of the primary current corresponding to the moments when the primary switch is turned on are the same, thus eliminating low-frequency flickers caused by the asymmetry of the valley switch in traditional LED driving system. Further, by introducing the zero current detection latch signal and the delayed minimum turn-off time signal, the switch will be forced to be turned on as long as the zero current detection latch signal and the delayed minimum turn-off time signal are both valid, thereby eliminating flickers even in deeply dimming and improving user experiences.

As shown in FIG. 5B, the VDRAIN (voltage at the drain terminal of the switch M1) corresponding to the situation of $2^{nd}$ valley switching to the $1^{st}$ valley and the situation of $1^{st}$ valley switching to the $2^{nd}$ valley is kept at V3, and the VDRAIN corresponding to the situation of $3^{rd}$ valley switching to the $2^{nd}$ valley and the situation of $2^{nd}$ valley switching to the $3^{rd}$ valley is kept at V1. That is, the VDRAIN corresponding to the situation when the $n^{th}$ valley switching to the $(n-1)^{th}$ valley is the same as the VDRAIN corresponding to the situation when the (n−1) valley switching to the $n^{th}$ valley.

Figure 5C:
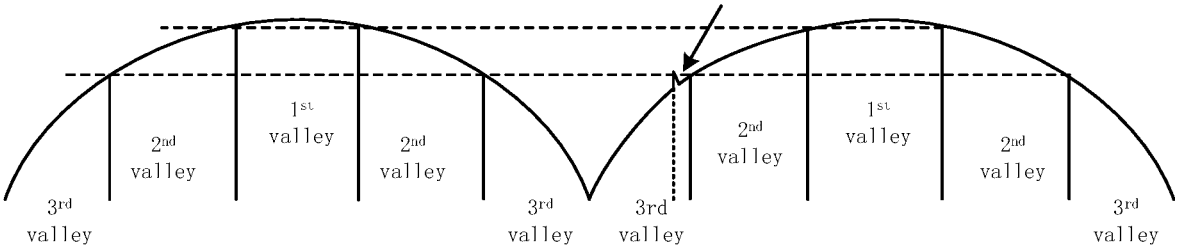
FIG. 5C is a diagram of line voltage with spike and corresponding moments of turn-on of the switch in the LED driving system in accordance with the present invention.

As shown in FIG. 5C, when the $3^{rd}$ valley is switching to the $2^{nd}$ valley, at the position indicated by the arrow in the figure, a spike of bus voltage Vin will only cause a short time period of operation in the $2^{nd}$ valley. When the spike disappears later, the turn-on moment of the switch M1 will soon return to the $3^{rd}$ valley. The difference of operation time between the $2^{nd}$ valley and the $3^{rd}$ valley is small, so that the difference between average values of output current between the $2^{nd}$ valley and the $3^{rd}$ valley is small. Therefore, the LED driving system of the present invention will not cause visible flickers.

Figure 6:
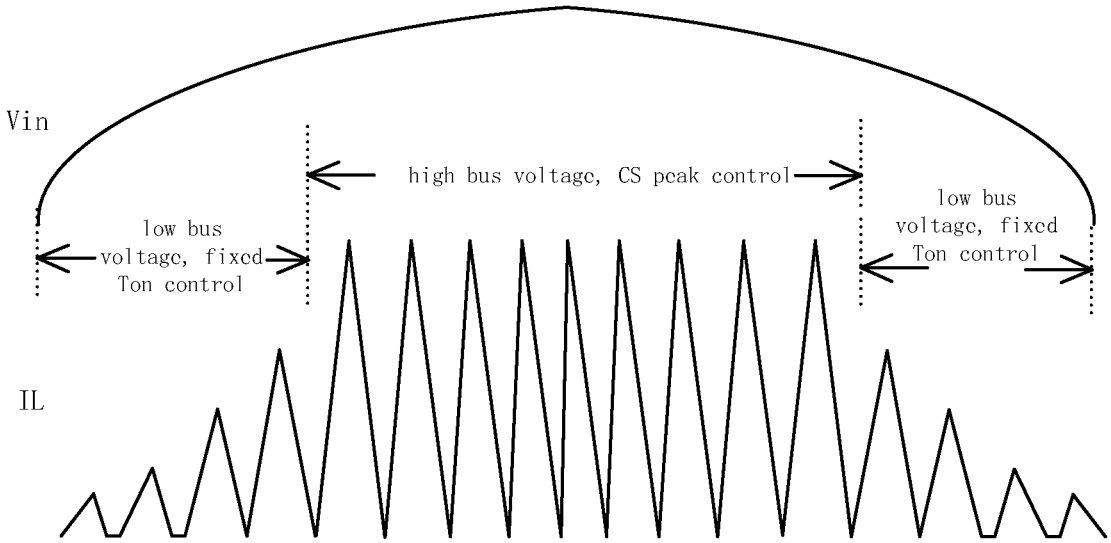
FIG. 6 is a diagram of line voltage and corresponding control method applied in the LED driving system in accordance with the present invention.

Please refer to FIG. 6, which is diagram of line voltage and corresponding control method applied in the LED driving system in accordance with the present invention. The LED driving system of the present invention may be controlled with a combination of the fixed turn-on time control method and CS peak control method (peak current control). The former one can achieve a PF of (0.9~0.99), while the latter one can achieve a PF of (0.7~0.9). Specifically, the fixed turn-on time control method is applied when the bus voltage Vin is relatively low, and the CS peak control is used when the bus voltage Vin is relatively high.

Figure 7:
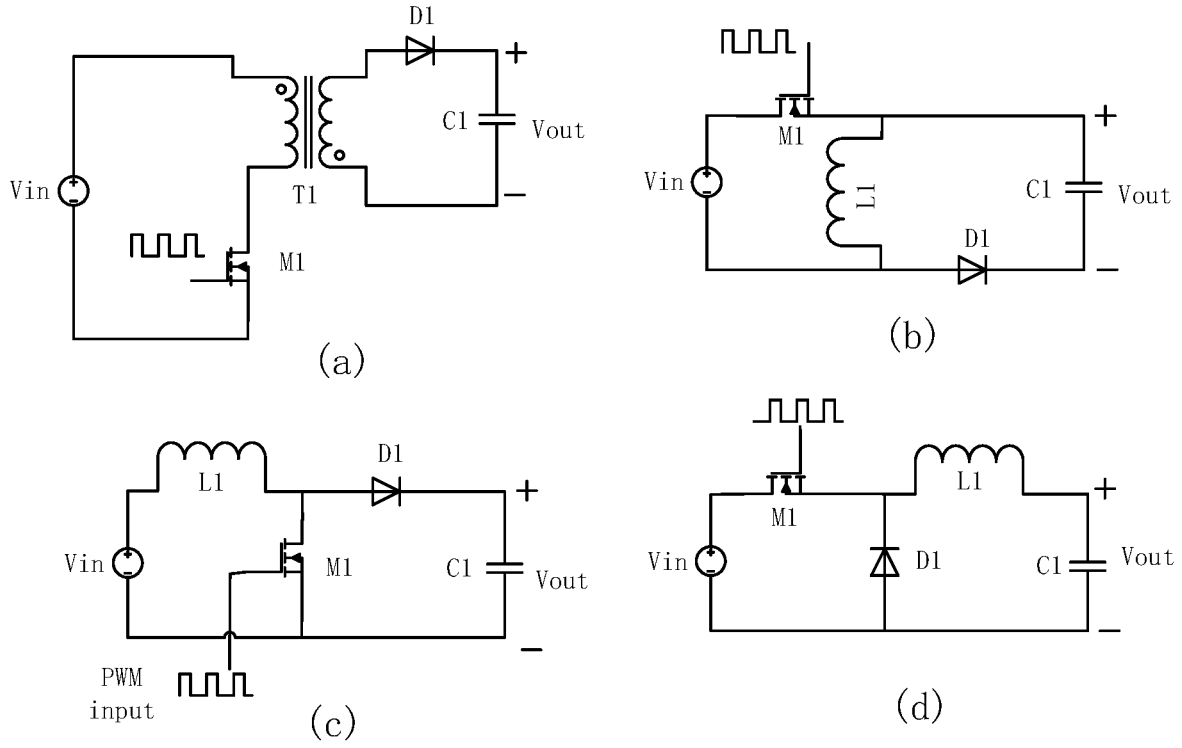
FIG. 7 is a schematic diagram of various topologies applicable with the LED driving method in accordance with the present invention.

Please refer to FIG. 7, which is a schematic diagram of various topologies applicable with the LED driving method in accordance with the present invention. The LED driving system is not only suitable for isolated flyback topology with power factor correction (APFC) (shown as a in FIG. 7), but also suitable for non-isolated buck-boost topology with power factor correction (APFC) (shown as b in FIG. 7), non-isolated boost topology with power factor correction (APFC) (shown as c in FIG. 7), and non-isolated buck topology with power factor correction (APFC) (shown as d in FIG. 7).

INDUSTRIAL APPLICABILITY

The subject of the present invention can be manufactured and used in industry, and thus has industrial applicability.

What is claimed is:

1. A control circuit for a power converter wherein the control circuit receives a feedback signal from the power converter and generate a zero current detection (ZCD) pulse signal accordingly, indicating one or more moments when the feedback signal decreases to zero, and receives a dimming signal and generates a minimum turn-off time signal accordingly, indicating the moment when a minimum turn-off time is passed, and wherein the control circuit generates a first turn-on signal according to the ZCD pulse signal and the minimum turn-off time signal to control a switching device within the power converter to turn on when the feedback signal decreases to zero and the minimum turn-off time is passed;

the control circuit is further provided with a FB pin and a demagnetization detection module, of which the demagnetization detection module is configured to connect with the FB pin and receive the feedback signal obtained from the power converter.

2. The control circuit according to claim 1, wherein the control circuit is further configured to receive a dimming instruction signal and generate the dimming signal accordingly.

3. The control circuit according to claim 1, wherein the control circuit comprising:

a single pulse generator configured to receive the feedback signal, generate the ZCD pulse signal accordingly, and output the ZCD pulse signal to a first input end of a first logic unit;

a minimum turn-off time unit configured to receive the dimming signal, generate the minimum turn-off time signal accordingly, and output the minimum off-time signal to a second input end of the first logic unit; and the first logic unit configured to generate the first turn-on signal based on the ZCD pulse signal and the minimum turn-off time signal.

4. The control circuit according to claim 3, wherein the first logic unit comprises a first AND gate which receives the ZCD pulse signal and the minimum turn-off time signal to generate the first turn-on signal.

5. The control circuit according to claim 3, wherein the control circuit is further configured to generate a first reference voltage according to the dimming signal, generate an output current sampling signal indicating a current flowing through the switching device, and generate a turn-off signal according to the first reference voltage and the output current sampling signal to control the switching device to turn off.

6. The control circuit according to claim 5, wherein a second logic unit comprises a first RS flip-flop, which receives the first turn-on signal via a set input end and the turn-off signal via a reset input end, and generates a switch control signal to control the switching device.

7. The control circuit according to claim 5, wherein the control circuit further comprising:

a reference voltage generation unit configured to receive the dimming signal, generate a first reference voltage accordingly and output the first reference voltage to an error amplifier; and the error amplifier configured to generate a compensation signal according to the first reference voltage and the output current sampling signal, and output the compensation signal to a comparator; and the comparator configured to compare the compensation signal with a ramp signal to generate the turn-off signal.

8. The control circuit according to claim 1, wherein the control circuit is further configured to generate a latched ZCD pulse signal according to the feedback signal, and a delayed minimum turn-off time signal according to the dimming signal, and to generate the first turn-on signal according to the latched ZCD pulse and the delayed minimum turn-off time signal to control the switching device to turn on when the first moment of the feedback signal decreasing to zero has arrived and the delayed minimum turn-off time is passed.

9. The control circuit according to claim 8, wherein the control circuit comprising:

a single pulse generator configured to receive the feedback signal, generate the ZCD pulse signal accordingly, and output the ZCD pulse signal to a first logic unit; and a minimum turn-off time unit configured to receive the dimming signal, generate the minimum turn-off time signal and the delayed minimum turn-off time signal accordingly, and output the minimum turn-off time signal and the delayed minimum turn-off time signal to the first logic unit; and a second logic unit configured to receive the feedback signal, generate the latched ZCD pulse signal accordingly, and output the latched ZCD pulse signal to the first logic unit, and wherein the first logic unit is configured to generate the first turn-on signal.

10. The control circuit according to claim 5, wherein the control circuit comprises a second logic unit which is configured to receive the feedback signal and the switch control signal to generate a latched ZCD pulse signal.

11. The control circuit according to claim 5, wherein the control circuit further comprising:

a reference voltage generation unit configured to receive the dimming signal, generate a first reference voltage accordingly and output the first reference voltage to a digital low-pass filter; and the digital low-pass filter configured to generate a compensation signal according to the first reference voltage and the output current sampling signal, and output the compensation signal to a comparator; and the comparator configured to compare the compensation signal with a ramp signal to generate the turn-off signal.

12. The control circuit according to claim 1, wherein the control circuit is configured to receive the dimming signal via a DIM pin and receive the feedback signal via the FB pin.

13. An LED driving system, including an AC power supply, a rectifier, a bus capacitor, a magnetic device, a switching device, and one or more LED loads, wherein the AC power supply is coupled to the magnetic device to drive the LED loads; and wherein the LED driving system further comprises a control circuit, which receives a feedback signal from the magnetic device and generate a ZCD pulse signal accordingly, indicating one or more moments when the feedback signal decreases to zero, and receives a dimming signal and generate a minimum turn-off time signal accordingly, indicating the moment when a minimum turn-off time is passed, and wherein the control circuit generates a first turn-on signal according to the ZCD pulse signal and the minimum turn-off time signal to control the switching device to turn on when the feedback signal decreases to zero and the minimum turn-off time is passed;

the control circuit is further provided with a FB pin and a demagnetization detection module, of which the demagnetization detection module is configured to connect with the FB pin and receive the feedback signal obtained from a power converter.

14. An LED driving method applied in an LED driving system, wherein the LED driving method comprising:

receiving a feedback signal obtained from a power converter and generating a ZCD pulse signal accordingly by a demagnetization detection module, wherein the ZCD pulse signal indicates one or more moments when the feedback signal decreases to zero; and receiving a dimming signal and generating a minimum turn-off time signal accordingly, which indicates the moment when a minimum turn-off time is passed; and generating a first turn-on signal according to the ZCD pulse signal and the minimum turn-off time signal;

generating a switch control signal according to the first turn-on signal, controlling a switching device to turn on when the feedback signal decreases to zero and the minimum turn-off time is passed.

15. The LED driving method according to claim 14, wherein the LED driving method further comprises:

generating a latched ZCD signal according to the feedback signal and a delayed minimum turn-off time signal according to the dimming signal; and generating a second turn-on signal according to the latched ZCD signal and the delayed minimum turn-off time signal; and generating the switch control signal according the second turn-on signal and the first turn-on signal to control the switching device.

* * * * *